United States Patent [19]

Klomp

[11] Patent Number: 4,576,338

[45] Date of Patent: Mar. 18, 1986

[54] FUEL INJECTOR WITH HOOP NOZZLE SPRAY TIP

[75] Inventor: Edward D. Klomp, Mount Clemens, Mich.

[73] Assignee: General Motors Corporation, Detroit, Mich.

[21] Appl. No.: 645,278

[22] Filed: Aug. 29, 1984

[51] Int. Cl.[4] ..... B05B 1/32; F02M 47/00

[52] U.S. Cl. ..... 239/452; 239/533.3; 239/533.6; 239/533.12; 239/533.13; 239/574; 239/576; 137/853

[58] Field of Search ..... 239/453, 459, 533.3–533.13, 239/546, 574, 576, 602, 452; 137/853, 860

[56] References Cited

U.S. PATENT DOCUMENTS

| | | | |
|---|---|---|---|
| 2,244,394 | 6/1941 | Hautzenroeder | 239/453 |
| 2,630,326 | 3/1953 | Bryant | 137/853 X |
| 2,831,730 | 4/1958 | Pflaum | 239/533.9 X |
| 3,282,513 | 11/1966 | Savage | 239/533.13 |
| 3,528,613 | 9/1970 | Berlyn | 239/453 |
| 4,099,494 | 7/1978 | Goloff et al. | 239/533.13 X |

FOREIGN PATENT DOCUMENTS

| | | | |
|---|---|---|---|
| 1252754 | 12/1960 | France | 137/853 |

*Primary Examiner*—Andres Kashnikow
*Assistant Examiner*—Mary Beth Jones
*Attorney, Agent, or Firm*—Arthur N. Krein

[57] ABSTRACT

The spray tip of a diesel fuel injector, downstream of a conventional pressure actuated injector needle valve, includes a plug holder used to support and retain a hollow inner plug valve element, containing a number of radial through orifices communicating with an annular groove in the outer peripheral surface of the plug valve element and an outer hoop valve element with a hoop-skirt valve encircling the inner plug valve element. A shrink-fit exists between the hoop-skirt valve and the inner plug valve element to provide for a zero sac volume spray tip. The hoop-skirt valve operates as an integral hoop valve which is expanded relative to the inner plug valve element when supplied with high pressure fuel to form therewith a fuel discharge annulus.

3 Claims, 4 Drawing Figures

FUEL INJECTOR WITH HOOP NOZZLE SPRAY TIP

FIELD OF THE INVENTION

This invention relates to fuel injection nozzles and, in particular, to such a nozzle construction having a hoop nozzle spray tip.

DESCRIPTION OF THE PRIOR ART

Various fuel injectors, especially of the needle valve type, have so-called "sac" volumes within their nozzle tips. Accordingly after a fuel injection cycle with the needle valve then seated against an associate valve seat, a small amount of fuel remains within the sac volume in the nozzle tip, which, during the combustion cycle in the associate engine cylinder, can then dribble out or be vaporized. However, since some or all of this sac volume may not be consumed during the combustion cycle, it will then be emitted from the engine as a hydrocarbon emission.

Accordingly, the desirability of substantially reducing or completely eliminating the sac volume in fuel injection nozzles has long been recognized and various prior art nozzle structures have been proposed to accomplish such reduction or elimination of the sac volume as disclosed, for example, in U.S. Pat. No. 4,099,494 entitled Fuel Spray, issued July 11, 1978 to Alexander Goloff and Frank E. Keske or in U.S. Pat. No. 4,106,702 entitled Fuel Injection Nozzle Tip with Low Volume Tapered Sac, issued Aug. 15, 1978 to John W. Gardner; William A. Grgurich and Albert B. Niles.

SUMMARY OF THE INVENTION

The present invention relates to a fuel injector having a hollow nozzle body with a discharge opening at the outlet end thereof, flow through which is controlled by a conventional needle valve. Fixed to the outlet end of the nozzle body is a hoop nozzle spray tip assembly that includes a hollow inner plug in flow communication with the discharge opening and having circumferentially spaced apart radial fuel discharge orifices in communication with an annular groove on the exterior surface of the inner plug and an outer hoop having a hoop skirt tightly encircling the inner plug adjacent to the discharge orifices and annular groove so as to operate as a hoop valve with zero sac volume, but which is adapted to expand radially relative to the inner plug to form therewith a fuel discharge annulus.

It is therefore a primary object of this invention to provide an improved fuel injector for use in the fuel injection system of an internal combustion engine wherein the fuel injector has a hoop nozzle spray tip with no sac volume, that is, the nozzle spray tip is a zero sac nozzle.

Another object of the invention is to provide an improved fuel injector having a pressure actuated needle valve controlling fuel flow to a hollow inner plug having radial orifices therethrough to an outer annular groove, the inner plug being tightly encircled by a hoop skirt which is adapted to expand radially outward by high pressure fuel so as to define with the inner plug a fuel discharge annulus.

For a better understanding of the invention, as well as other objects and further features thereof, reference is had to the following detailed description of the invention to be read in connection with the accompanying drawings.

DESCRIPTION OF THE INVENTION

Figure 1:
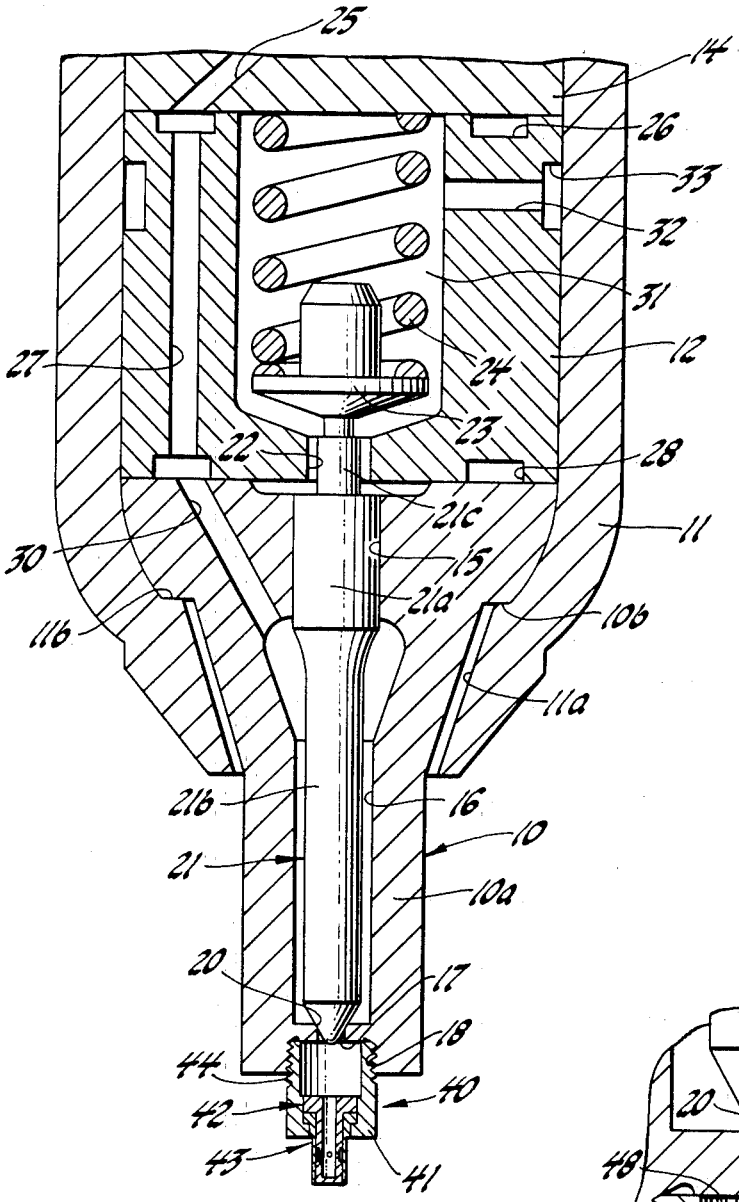
FIG. 1 is a longitudinal sectional view of a first embodiment fuel injector with hoop nozzle spray tip in accordance with the invention, the injector structure shown being of the type for incorporation into a unit fuel injector.

Although a fuel injector with hoop nozzle spray tip in accordance with the invention can be formed as a unit assembly, in the construction shown in FIG. 1, the subject fuel injector is configured so as to be assembled in a nut so as to operate as the fuel injector nozzle assembly in a unit fuel injector of the type shown, for example, in U.S. Pat. No. 4,392,612 entitled Electromagnetic Unit Fuel Injector, issued July 12, 1983 to John I. Deckard and Robert D. Straub, the disclosure of which is incorporated herein by reference thereto.

Accordingly, in the construction shown in FIG. 1, the fuel injector includes an injector valve body or nozzle spray tip 10, hereinafter referred to as the spray tip, which has a reduced diameter lower end 10*a* which extends through an opening 11*a* in the lower end of a unit injector nut 11. As shown, the spray tip 10 is enlarged at its upper end to provide a shoulder 10*b* which seats on an internal shoulder 11*b* provided by the normal through counter bore in the nut 11.

Stacked above the spray tip 10 within the nut 11 is a spring cage 12 and a spring retainer 14, these elements being formed, in the construction illustrated, as separate elements for ease of manufacturing and assembly. As conventional, all of these elements have lapped mating surfaces whereby they can be held in pressure sealed relationship to each other in a manner well known in the art.

The spray tip 10, in the construction illustrated, is provided with a stepped bore therethrough to define an upper valve piston guide bore 15, an upper intermediate wall defining a central passage 16, a lower intermediate wall of reduced diameter defining a discharge passage 17, and a lower internally threaded wall 18. A tapered annular valve seat 20 encircles the discharge passage 17 at the upstream end thereof in terms of the direction of fuel flow.

Flow through the discharge passage 17 is controlled by means of a conventional injector needle valve 21 movably positioned in the spray tip 10 and which includes an upper piston portion 21*a* slidably received in the guide bore 15, a lower stem portion 21*b* loosely received in the central passage and having a valve tip at its lower free end for engagement with valve seat 20.

A reduced diameter upper end portion 21*c* of the needle valve 21 extends through a central opening 22 in the spring cage 12 and abuts a spring seat 23. Compressed between the spring seat 23 and the lower surface of the spring retainer 14 is a coil spring 24, of predetermined force, which normally biases the needle valve 21 to its closed position shown.

Pressurized fuel to effect an injection cycle is introduced into the passage 16 in a suitable manner, as desired, for a particular fuel injector application. For example, as used in a unit injector, fuel is supplied via an inclined passage 25 in the spring retainer 14 which opens into an annular groove 26 in the upper end of the spring cage 12. This groove 26 is connected with a similar annular groove 28 on the bottom face of the spring cage 12 by a longitudinal passage 27 through the spring cage 12. The lower groove 28 is, in turn, in flow communication via at least one inclined passage 30 in the spray tip 10 with the central passage 16 therein.

In order to prevent any tendency of fuel pressure to build up in the spring chamber 31 in the spring cage 12, this chamber 31 is vented through a radial port passage 32 to an annular groove 33 provided on the outer peripheral surface of the spring cage 12. While a relatively close fit exists between the interior wall surface of the nut 11 and the spring cage 12, spring retainer 14, and possibly other elements, not shown, there is sufficient diametral clearance between these parts for the venting of fuel back to a relatively low pressure area of the associate unit injector, as well known in the art.

Now in accordance with the invention, a hoop nozzle spray tip assembly, generally designated 40, is fixed to the lower end of the spray tip 10. The hoop nozzle spray tip assembly 40 in the embodiment shown in FIGS. 1 and 2, includes a tubular plug holder 41 used to support and retain an inner plug valve element 42 and an outer hoop valve element 43 at the outlet end of the spray tip 10.

The plug holder 41 is of hollow tubular configuration and is adapted to be suitably secured into the cavity defined by the lower wall 18 of the spray tip, as by being provided with external threads 44 for threaded engagement with the internal threaded lower wall 18. Plug holder 41 is provided with a stepped through bore which defines at least an intermediate wall 45 of predetermined internal diameter and a lower wall 46 of reduced diameter with a flat shoulder 47 interconnecting these walls. In the construction shown, this stepped bore also defines an upper wall 48 of an internal diameter slightly larger than that of the intermediate wall 45.

The inner plug valve element 42 is of T-shaped annular configuration having an upper radial flange 50 of a suitable external diameter to be received by wall 45 of the plug holder 41 with a depending circular valve seat 51 depending therefrom which is of a predetermined external diameter for a purpose to be described in detail hereinafter. A central blind bore extends into the inner plug valve element 42 to terminate at a lower plug wall 52 to define a discharge passage 53, which together with the cavity defined by wall 48 form, in effect, an extension of the discharge passage 17.

In addition, the valve seat 51 portion of the inner plug valve element 42, adjacent to the lower end thereof which extends axially outward from the plug holder 41 is provided with a plurality of circumferentially, equally spaced apart radial discharge ports 54 to effect flow communication from the discharge passage 53 to an annular reservoir groove 55 formed in the outer peripheral surface of the valve seat 51. In the construction illustrated, four such discharge ports 54 are provided, although only three are shown in FIGS. 1 and 2.

The outer hoop valve element 43 is also of T-shaped annular configuration having an upper radial flange 60, of a suitable external diameter to be received by the wall 45 of the plug holder 41, with an externally stepped hoop skirt depending therefrom, which includes an upper portion 61 of an external diameter so as to be slidably received by the lower wall 46 of the plug holder and a lower thin-walled hoop-skirt valve 62 portion. The internal wall diameter of the hoop-skirt valve 62 portion is preselected relative to the external diameter of the valve seat 51 portion of the inner plug valve element 42 whereby, as assembled as shown, a shrink fit exists between the hoop-skirt valve 62 and the valve seat 51.

Figure 2:
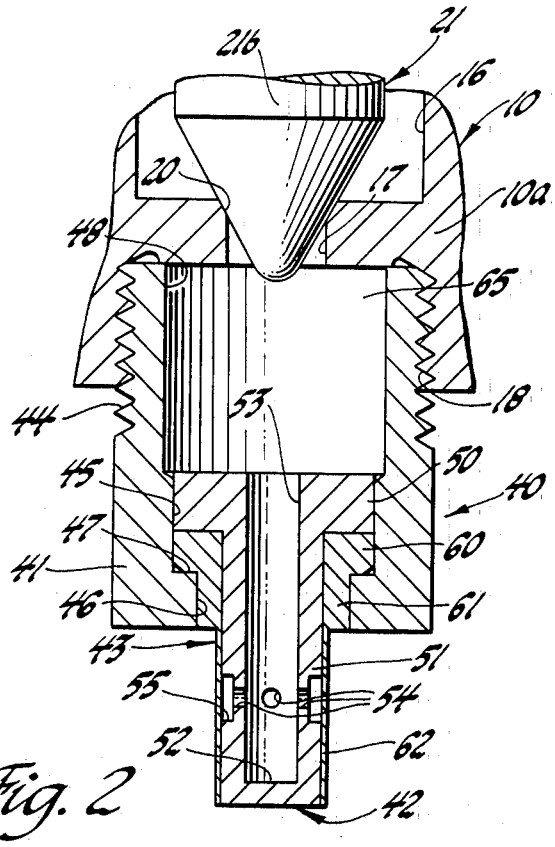
FIG. 2 is an enlarged sectional view of the hoop nozzle spray tip portion of the fuel injector of FIG. 1.

As shown in FIGS. 1 and 2, the passage 53 and wall 48 define a sac volume chamber 65 downstream of the injector needle valve 21 and, as previously described, form an extension of the discharge passage 17.

FUNCTIONAL DESCRIPTION

As well known in the art, the injector needle valve 21 will lift off valve seat 20 and again seat thereagainst at predetermined fuel pressures, as desired for a particular application. Accordingly, in the subject fuel injector as the injector needle valve 21 is lifted from the valve seat 20 at a predetermined pressure of fuel supplied into the central passage 16, the fuel in the sac volume chamber 65 and discharge passage 53 will also be exposed to this pressurized fuel via the discharge passage 17. This high pressure fuel in the sac volume chamber 65 via discharge passage 53 will also communicate pressure to the interior wall surface of the hoop-skirt valve 62 through the discharge ports 54 and annular groove 55.

When this fuel pressure is sufficient to overcome the preselected preset hoop stress, caused by shrinking the hoop-skirt valve 62 over the valve seat 41 of the inner plug valve element 42, the hoop-skirt valve 62 will expand radially outward relative to the valve seat 51 whereby to define therewith a fuel discharge annulus through which fuel can be discharged into an associate cylinder, not shown, of an engine. Injection is completed when the injector needle valve 21 closes in response to a sudden drop in fuel pressure caused in a conventional manner known in the art, for example, as by opening of a drain valve. This drop in fuel pressure will permit the hoop-skirt valve 62 to once again hug the annular valve seat 51 and seal the discharge ports 54 and annular groove 55 from the associate cylinder conditions.

Figure 3:
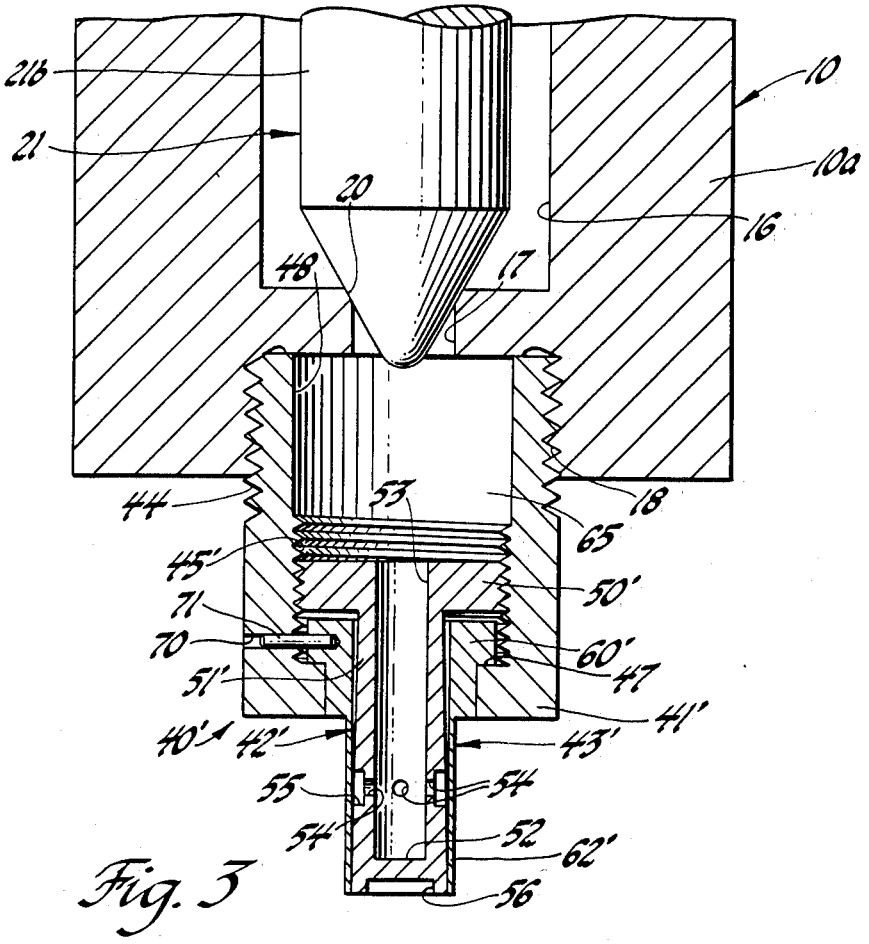
FIG. 3 is an enlarged sectional view of an alternate hoop nozzle spray tip portion for a fuel injector; and, FIG. 4 is an enlarged end view of the hoop skirt portion, per se, of the hoop nozzle spray tip of FIGS. 1, 2 and 3.

Since the magnitude of the preset stress of the hoop-skirt valve 62 against the annular valve seat is important and should preferably be adjustable, there is shown in FIG. 3 an alternate preferred embodiment of a fuel injector with hoop nozzle spray tip, wherein similar parts are designated by similar numerals but with the addition of a prime (') where appropriate, that has a spray tip assembly 40' that is structured so that the prestress can be adjusted, as desired, in a manner to be described in detail hereinafter.

Accordingly, in this FIG. 3 embodiment, the plug holder 41' has its internal intermediate wall 45' provided with internal threads and the radial flanges 50' and 60' of the inner plug valve element 42' and outer hoop valve element 43', respectively, are provided with corresponding external threads. In addition, in this preferred embodiment, the annular valve seat 51' of the inner plug valve element 42' is tapered radially inward from its lower free end to its upper end adjacent to the radial flange 50'. This taper is shown exaggerated in FIG. 3, but in actual practice the external diameter at the lower free end would only be tapered on the order of, for example, 0.020 mm/mm for an inner plug valve element 42' having an external diameter of, for example, 4 mm at its free end at the radial flange 50' end of the valve seat 51'. The lower closed or plug end of the inner plug valve element 42' is also provided with an internal wrench socket, such as the screwdriver slot 56 whereby a rotative torque can be applied to this element for a purpose to be described.

With reference to this FIG. 3 embodiment, both the inner plug valve element 42' and the outer hoop valve element 43' should be finished machined to the desired size dimension, as desired, for a particular application, except for the outer diameter of the hoop-skirt valve 62' which is preferably ground to size after its assembly to the inner plug valve element 42'. Thereafter the outer hoop valve element 43' is assembled to the inner plug valve element 42'. In order to prestress the hoop-skirt valve 62', a shrink fit must exist between this element and the annular valve seat 51', which is accomplished by providing a suitable predetermined temperature differential between these elements before they are assembled together as well known in the manufacturing art.

This subassembly of the inner plug valve element 42' and outer hoop valve element 43' is then threaded into the plug holder 41' until the radial flange 60' of the outer hoop valve element 43' abuts against the shoulder 47 of the plug holder 41'. Thereafter, a suitable radial hole 70 is drilled through the wall of the plug holder 41' and into the radial flange 60' and then a retainer pin 71 is installed therein to prevent rotation of the outer hoop valve element 43' relative to the plug holder 41' during machining, that is, grinding of the hoop-skirt valve 62' portion to a predetermined wall thickness. Thereafter, a suitable tool such as a screwdriver, not shown, inserted into the screwdriver slot 56 can be used to generate a relative axial motion of the inner plug valve element 42' in either direction as desired so as to place the free end of the hoop-skirt valve 62' at a different valve seat 51' external diameter (radius) and thereby adjust the prestress, as desired.

Figure 4:
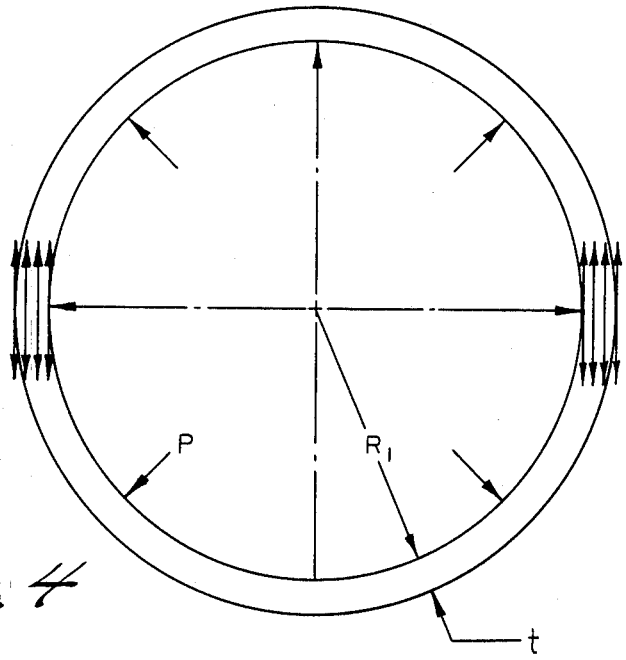

The physics governing the operation of the subject hoop nozzle spray tip can best be explained with reference to FIG. 4 which can be used to derive the desired relationship between the annulus discharge slot width ΔR which determines the annulus discharge flow-area required for a preselected injection flow rate and, the controlling parameters which are as follows:

$R_1$—hoop-skirt valve 62 radius, preselected relative to the preselected external diameter of the inner plug valve element 42, with reference to the FIGS. 1 and 2 embodiment.

t—hoop-skirt valve 62 wall thickness.

P—Fuel injection pressure (desired valve opening pressure).

E—Modulus of elasticity of the material of the hoop-skirt valve 62.

The required wall thickness of the hoop-skirt valve 62 needed for a preselected prestress S can be calculated from the following equation:

$$t = P\frac{R_1}{S + \Delta S} \tag{1}$$

where S is the prestress and ΔS is the increase in stress over the prestress caused by P.

The hoop-skirt valve circumferential elongation e can be calculated from the following equation:

$$e = \frac{2\pi R_1(\Delta S)}{E} \tag{2}$$

or $$e = \frac{2\pi R_1}{E}\left\{\frac{PR_1}{t} - S\right\} \tag{3}$$

The new hoop-skirt valve radius R2 is $$R_2 = R_1 + \frac{e}{2\pi} \text{ or} \tag{4}$$

$$\Delta R = \frac{e}{2\pi} \tag{5}$$

Using equation (3) in (5) and simplifying yields, $$\Delta R = \frac{R_1}{E}\left\{\frac{PR_1}{t} - S\right\} \tag{6}$$

While the invention has been described with reference to the structures disclosed herein, it is not confined to the specific details set forth, since it is apparent that various modifications and changes can be made by those skilled in the art. This application is therefore intended to cover such modifications or changes as may come within the purpose of the improvements or scope of the following claims.

The embodiments of the invention in which an exclusive property or privilege is claimed are defined as follows:

1. A fuel injection nozzle with hoop nozzle spray tip including a valve body means having a stepped bore therethrough to define at one end of said valve body means an outlet passage with a valve seat encircling the inboard end of said outlet passage; a passage means in said valve body means in flow communication at one end with said stepped bore inboard of said valve seat and being connectable at its opposite end to a source or pressurized fuel; an injector valve means movable in said valve body means relative to said valve seat to control flow to said outlet passage; a hollow, closed end, inner plug valve element operatively fixed to said valve body means so as to serve as an extension of said outlet passage; said inner plug valve element having an outer peripheral valve seat surface with an annular groove therein and having spaced apart port passages for effecting flow communication between said outlet passage and said annular groove; and, a cylindrical outer hoop valve element with a straight thin annular hoop-skirt valve of predetermined radial thickness operatively fixed to said valve body means with said hoop-skirt valve in shrink-fit encirclement of said inner plug valve element so as to overlie said annular groove whereby said hoop-skirt valve is prestressed and is operative as an integral hoop valve which is adapted to expand radially relative to said inner plug valve element, when said passage means and said outlet passage are supplied with fuel at a predetermined high pressure as controlled by said injector valve means, to form therewith a fuel discharge annulus.

2. A fuel injection nozzle with hoop nozzle spray tip including a valve body means having a stepped bore therethrough to define at one end of said valve body means an outlet passage with a valve seat encircling the inboard end of said outlet passage; a passage means in said valve body means in flow communication at one end with said stepped bore inboard of said valve seat and said outlet passage and said connectable at its opposite end to a source of pressurized fuel; an injector valve means movable in said valve body relative to said valve seat whereby to control flow to said outlet passage; a hollow cylindrical, closed end, inner plug valve element having an outer peripheral surface defining an annular valve seat surface with an annular groove on its outer peripheral surface and having a number of radial through ports thereto next adjacent to its closed end operatively fixed to said valve body means so as to operatively serve as an extension of said outlet passage; and, an outer cylindrical hoop valve element with a thin, straight annular hoop-skirt valve portion of predetermined radial thickness operatively fixed to said valve body means with said hoop-skirt valve portion in shrink-fit encirclement of said annular valve seat of said plug valve element and to thereby overlie said annular groove whereby said hoop-skirt valve is operative as an integral prestressed hoop valve which is adapted to expand radially relative to said plug valve element when said outlet passage is supplied fuel at a predetermined high pressure as controlled by said injector valve means, to form therewith a flow annulus for the discharge of fuel.

3. A fuel injection nozzle with hoop nozzle spray tip according to either claim 1 or claim 2 wherein the said outer peripheral valve seat surface of said inner plug valve element is tapered radially inward from its free end to at least said annular groove, and wherein said inner plug valve element is axially movable relative to said outer hoop valve element whereby the shrink-fit of said hoop-skirt valve to said plug valve element can be adjusted to provide a preselected prestress on said hoop-skirt valve.

* * * * *

UNITED STATES PATENT AND TRADEMARK OFFICE

CERTIFICATE OF CORRECTION

PATENT NO. : 4,576,338

DATED : March 18, 1986

INVENTOR(S) : Edward D. Klomp

It is certified that error appears in the above—identified patent and that said Letters Patent is hereby corrected as shown below:

Column 6, line 42, "or" should read -- of --.

Column 8, line 5, after "supplied" insert -- with --.

Signed and Sealed this

*Eighth* Day of *July 1986*

[SEAL]

*Attest:*

DONALD J. QUIGG

*Attesting Officer*

*Commissioner of Patents and Trademarks*